US009050651B2

(12) United States Patent
Shore

(10) Patent No.: US 9,050,651 B2
(45) Date of Patent: Jun. 9, 2015

(54) METHOD FOR PRODUCING LEAD-FREE COPPER—BISMUTH ALLOYS AND INGOTS USEFUL FOR SAME

(75) Inventor: David Shore, Weston (CA)

(73) Assignee: Ingot Metal Company Limited, Weston (CA)

( * ) Notice: Subject to any disclaimer, the term of this patent is extended or adjusted under 35 U.S.C. 154(b) by 970 days.

(21) Appl. No.: 13/159,562

(22) Filed: Jun. 14, 2011

(65) Prior Publication Data

US 2012/0321506 A1 Dec. 20, 2012

(51) Int. Cl.

| | |
|---|---|
| ***C22C 13/00*** | (2006.01) |
| ***C22C 18/00*** | (2006.01) |
| ***B22D 7/02*** | (2006.01) |
| ***B22D 9/00*** | (2006.01) |
| ***C22C 9/00*** | (2006.01) |
| ***C22C 9/02*** | (2006.01) |
| ***C22C 9/04*** | (2006.01) |
| ***C22C 13/02*** | (2006.01) |
| ***C22C 30/02*** | (2006.01) |
| ***C22C 30/04*** | (2006.01) |
| ***C22C 30/06*** | (2006.01) |

(52) U.S. Cl.

CPC .. *B22D 7/02* (2013.01); *B22D 9/00* (2013.01); *C22C 9/00* (2013.01); *C22C 9/02* (2013.01); *C22C 9/04* (2013.01); *C22C 13/00* (2013.01); *C22C 13/02* (2013.01); *C22C 18/00* (2013.01); *C22C 30/02* (2013.01); *C22C 30/04* (2013.01); *C22C 30/06* (2013.01)

(58) Field of Classification Search

None

See application file for complete search history.

(56) References Cited

U.S. PATENT DOCUMENTS

| | | | | | |
|---|---|---|---|---|---|
| 2,369,028 | A | * | 2/1945 | Deitz, Jr. | 420/476 |
| 3,190,751 | A | * | 6/1965 | Blazek | 420/476 |
| 4,248,905 | A | * | 2/1981 | Harvey | 427/11 |
| 4,358,884 | A | * | 11/1982 | Harvey et al. | 29/402.18 |
| 4,708,739 | A | | 11/1987 | Kellie et al. | |
| 4,751,049 | A | * | 6/1988 | Shannon | 420/477 |
| 4,879,094 | A | * | 11/1989 | Rushton | 420/476 |
| 4,929,423 | A | * | 5/1990 | Tucker et al. | 420/561 |
| 5,137,685 | A | * | 8/1992 | McDevitt et al. | 420/477 |
| 5,330,712 | A | | 7/1994 | Singh | |
| 5,344,606 | A | * | 9/1994 | Brimmer | 420/473 |
| 5,439,639 | A | * | 8/1995 | Vianco et al. | 420/562 |
| 5,487,867 | A | | 1/1996 | Singh | |
| 5,641,454 | A | * | 6/1997 | Kito et al. | 420/562 |
| 6,383,643 | B1 | * | 5/2002 | De Jarlais | 428/418 |
| 6,503,338 | B1 | * | 1/2003 | Taguchi et al. | 148/23 |
| 7,776,163 | B2 | * | 8/2010 | Xu et al. | 148/433 |
| 8,470,101 | B2 | * | 6/2013 | Kobayashi et al. | 148/434 |
| 2001/0002982 | A1 | * | 6/2001 | Sarkhel et al. | 420/590 |
| 2002/0040624 | A1 | * | 4/2002 | Nakamura et al. | 75/252 |
| 2002/0110478 | A1 | * | 8/2002 | Lawrence | 420/476 |
| 2004/0094243 | A1 | * | 5/2004 | Wynne et al. | 148/433 |
| 2004/0140022 | A1 | * | 7/2004 | Inohana et al. | 148/553 |
| 2005/0039827 | A1 | * | 2/2005 | Yamagishi et al. | 148/554 |
| 2005/0142685 | A1 | * | 6/2005 | Ouellet et al. | 438/51 |
| 2006/0210420 | A1 | * | 9/2006 | Yoshikawa et al. | 420/562 |
| 2007/0178007 | A1 | * | 8/2007 | Thantrong et al. | 420/557 |
| 2008/0253924 | A1 | * | 10/2008 | Oishi | 420/477 |
| 2009/0092517 | A1 | * | 4/2009 | Kosaka et al. | 420/471 |
| 2009/0133855 | A1 | * | 5/2009 | Hsieh et al. | 165/104.26 |
| 2009/0263272 | A1 | * | 10/2009 | Uchida | 420/471 |
| 2012/0018048 | A1 | * | 1/2012 | Yamashita et al. | 148/24 |
| 2012/0121455 | A1 | * | 5/2012 | Murray et al. | 420/471 |
| 2012/0237393 | A1 | * | 9/2012 | Murray et al. | 420/473 |

FOREIGN PATENT DOCUMENTS

| | | | | |
|---|---|---|---|---|
| CA | 2496584 | A1 | * | 3/2004 |
| CN | 101492780 | A | | 7/2009 |
| CN | 101709404 | A | * | 5/2010 |
| CN | 102168208 | A | | 8/2011 |
| GB | 512143 | | | 8/1939 |
| JP | 57-094540 | A | * | 6/1982 |
| JP | 2005-281714 | A | * | 10/2005 |
| JP | WO 2006/016624 | A1 | * | 2/2006 |

OTHER PUBLICATIONS http://www.cmxmetals.com/mechanical-ingot/ (accessed Jun. 14, 2011).

International Search Report for PCT/IB2012/001358 dated Nov. 20, 2012.

* cited by examiner

*Primary Examiner* — Kiley Stoner

(74) *Attorney, Agent, or Firm* — Ceasar Rivise, PC

(57) ABSTRACT

An ingot includes at least two metals selected from copper, tin, zinc and bismuth, wherein: (a) the ingot is a mechanical ingot, the at least two metals are 40-95 wt. % copper, 3-80 wt. % tin, 1-40 wt. % bismuth and/or 1-80 wt. % zinc, and other metals are present in a collective amount of 0-2 wt. %; or (b) the ingot is a cast ingot, the at least two metals are 40-80 wt. % copper, 3-80 wt. % tin, 1-40 wt. % bismuth and/or 1-80 wt. % zinc, and other metals are present in a collective amount of 0-2 wt. %, provided that when copper is present in the cast ingot in an amount greater than 69 wt. %, zinc is present in an amount less than 30 wt. %. Methods for preparing and casting the ingot are also disclosed, as is a system for casting a copper-bismuth alloy.

1 Claim, No Drawings

METHOD FOR PRODUCING LEAD-FREE COPPER—BISMUTH ALLOYS AND INGOTS USEFUL FOR SAME

BACKGROUND OF THE INVENTION

1. Field of Invention

This invention relates to methods for manufacturing copper-bismuth alloys, and to metal compositions used in said manufacturing.

2. Description of Related Art

Leaded brass and bronze ingot alloys are produced by blending several grades of feedstock metal in an electric or rotary furnace. The grades of feedstock used to produce these alloys often contain metallic impurities, such as aluminum, silicon and iron, along with non-metallics, such as plastic and dirt. These impurities are removed from the melt through refining of the molten bath or by the introduction of chemical fluxes to the molten bath.

Over the past ten years, there has been a steady increase in the demand for lead-free brass and bronze alloys, as replacements for leaded brass and leaded bronze alloys. This is largely due to the increasing worldwide demand for lead-free plumbing products.

Copper-bismuth alloys have been proposed as alternatives to leaded alloys. For example, U.S. Pat. No. 5,330,712 discloses that suitable brass alloys can be prepared by substituting bismuth for lead in the alloy composition. The resulting lead-free copper-bismuth alloys can be substituted for conventional leaded brasses in plumbing fixtures and other applications. See also U.S. Pat. No. 5,487,867.

Most preferred among the copper-bismuth alloys are C89833 and C89836 alloys. These alloys are considerably more expensive than the leaded alloys that they replace, based in part on the need to use high grades of copper in the manufacturing process so as to avoid lead contamination within the resulting alloys.

Lead-free casting alloys, such as C89833 and C89836, are considered to be a higher grade alloys compared to leaded brass and leaded bronze alloys. This is because, in order to ensure that the lead content within these alloys is as close to zero as possible, each melt is primarily composed of pure elements such as pure copper, tin, zinc and bismuth. Each of these alloys is also considered to be a much higher grade alloy because of the higher production costs.

Alternatively, higher grade alloys can be produced primarily with blends of various grades of feedstock metals, which generally have variations in metal chemistries within the same grades of feedstock, resulting in melts which might require adjustments to the chemistry by means of refining, dilutions or additions of certain elements prior to the casting of the ingot.

Both leaded and lead-free ingot alloys are typically supplied to foundries as a cast ingot with a certified analysis. This ingot is then re-melted and cast into a specific product.

Traditionally, high production foundries require a cast ingot in order to continually keep their furnaces full, and to keep up with high volume pouring rates. Feeding a furnace to capacity with the pure elements copper, tin, bismuth and zinc in the precise amounts necessary to produce C89833 and C89836 is a challenge requiring expertise and equipment that are not found in the average foundry.

It is therefore desired to address one or more of the foregoing issues by providing an improved method for producing substantially lead-free copper-bismuth alloys. It is further desired to provide such a method, wherein the copper-bismuth alloys are produced from scrap metal. It is still further desired to provide a simplified method for producing substantially lead-free copper-bismuth alloys, which can be reliably practiced in an average foundry.

BRIEF SUMMARY OF THE INVENTION

Accordingly, in a first aspect of the invention there is provided an ingot comprising at least two members selected from the group consisting of copper, tin, zinc and bismuth, wherein:

(a) the ingot is a mechanical ingot, the at least two members are present in the following amounts:

| Element | Percentage by Weight |
|---|---|
| Copper | 40-95 |
| Tin | 3-80 |
| Bismuth | 1-40 |
| Zinc | 1-80 |

and metals other than copper, tin, zinc and bismuth are present in a collective amount of 0-2 wt. %; or (b) the ingot is a cast ingot, the at least two members are present in the following amounts:

| Element | Percentage by Weight |
|---|---|
| Copper | 40-80 |
| Tin | 3-80 |
| Bismuth | 1-40 |
| Zinc | 1-80 |

and metals other than copper, tin, zinc and bismuth are present in a collective amount of 0-2 wt. %, provided that when copper is present in the cast ingot in an amount greater than 69 wt. %, zinc is present in an amount less than 30 wt. %.

In certain embodiments, the ingot is adapted to form a C89833 or C89836 alloy on melting with a predetermined amount of copper separate from the ingot. In certain of these embodiments, the ingot is a mechanical ingot further comprising 86-91 wt. % copper and the predetermined amount of copper is 0 wt. %.

In certain embodiments, the ingot comprises 86-91 wt. % copper, 4-6 wt. % tin, 2-6 wt. % zinc and 1.7-2.7 wt. % bismuth.

In certain embodiments, the ingot comprises 87-91 wt. % copper, 4-7 wt. % tin, 2-4 wt. % zinc and 1.5-3.5 wt. % bismuth.

In certain embodiments, the ingot comprises all three members of the group consisting of 4-7 wt. % tin, 2-6 wt. % zinc and 1.5-3.5 wt. % bismuth.

In certain embodiments, the ingot comprises at least three metals selected from the group consisting of copper, tin, zinc and bismuth, wherein:

(i) at least two of the at least three metals are mechanically combined such that the ingot is a heterogeneous mixture; and (ii) each of the at least three metals is present in the ingot in an amount adapted to form C89833 or C89836 alloy on melting the ingot alone or with a predetermined amount of a missing fourth member of the group.

In certain embodiments, the ingot is a mechanical ingot comprising at least one scrap metal.

In certain embodiments, the ingot comprises:

(a) 65-75 wt. % tin, 25-35 wt. % bismuth and less than 2 wt. % of metals other than tin and bismuth;

(b) 40-50 wt. % tin, 50-60 wt. % zinc and less than 2 wt. % of metals other than tin and zinc; or (c) 22-32 wt. % bismuth, 68-78 wt. % zinc and less than 2 wt. % of metals other than bismuth and zinc.

In certain embodiments, the ingot comprises:

(a) 65-75 wt. % copper, 25-35 wt. % zinc and less than 2 wt. % of metals other than copper and zinc, wherein the ingot is a mechanical ingot;

(b) 68-78 wt. % copper, 22-32 wt. % tin and less than 2 wt. % of metals other than copper and tin; or (c) 80-90 wt. % copper, 10-20 wt. % bismuth and less than 2 wt. % of metals other than copper and bismuth.

In certain embodiments, the ingot comprises:

(a) 60-70 wt. % copper, 20-30 wt. % tin, 5-15 wt. % bismuth and less than 2 wt. % of metals other than copper, tin and bismuth;

(b) 50-60 wt. % copper, 16-26 wt. % tin, 19-29 wt. % zinc and less than 2 wt. % of metals other than copper, tin and zinc; or (c) 33-43 wt. % tin, 12-22 wt. % bismuth, 40-50 wt. % zinc and less than 2 wt. % of metals other than tin, bismuth and zinc.

In certain embodiments, the ingot is a cast ingot comprising 33-43 wt. % tin, 12-22 wt. % bismuth, 40-50 wt. % zinc and less than 2 wt. % of metals other than tin, bismuth and zinc.

In a second aspect of the invention, there is provided a method of producing a casting, said method comprising the steps of:

melting the inventive ingot to provide a molten metal mixture;

filling a mold with the molten metal mixture; and cooling the molten metal mixture in the mold such that a casting is formed.

In certain embodiments, the method further comprises the step of combining the ingot with a composition comprising copper before, during or after the melting step such that the casting comprises C89833 or C89836 alloy. In certain of these embodiments, the composition is a scrap metal composition comprising at least one metal additional to copper in an amount of at least 1 wt. %.

In certain embodiments of the method, the ingot is a mechanical ingot comprising 86-91 wt. % copper, the casting comprises C89833 or C89836 alloy and all copper in the casting is provided by the ingot.

In certain embodiments of the method, the ingot comprises 86-91 wt. % copper, 4 6 wt. % tin, 2-6 wt. % zinc and 1.7-2.7 wt. % bismuth, and the casting comprises C89833 alloy.

In certain embodiments of the method, the ingot comprises 87-91 wt. % copper, 4-7 wt. % tin, 2-4 wt. % zinc and 1.5-3.5 wt. % bismuth, and the casting comprises C89836 alloy.

In certain embodiments of the method, the ingot comprises at least three metals selected from the group consisting of copper, tin, zinc and bismuth, wherein:

(i) at least two of the at least three metals are mechanically combined such that the ingot is a heterogeneous mixture; and (ii) each of the at least three metals is present in the ingot in an amount adapted to form C89833 or C89836 alloy on melting the ingot alone or with a predetermined amount of a missing fourth member of the group.

In certain embodiments of the method, the ingot comprises:

(a) 65-75 wt. % tin, 25-35 wt. % bismuth and less than 2 wt. % of metals other than tin and bismuth;

(b) 40-50 wt. % tin, 50-60 wt. % zinc and less than 2 wt. % of metals other than tin and zinc; or (c) 22-32 wt. % bismuth, 68-78 wt. % zinc and less than 2 wt. % of metals other than bismuth and zinc.

In certain embodiments of the method, the ingot comprises:

(a) 65-75 wt. % copper, 25-35 wt. % zinc and less than 2 wt. % of metals other than copper and zinc, wherein the ingot is a mechanical ingot;

(b) 68-78 wt. % copper, 22-32 wt. % tin and less than 2 wt. % of metals other than copper and tin; or (c) 80-90 wt. % copper, 10-20 wt. % bismuth and less than 2 wt. % of metals other than copper and bismuth.

In certain embodiments of the method, the ingot comprises:

(a) 60-70 wt. % copper, 20-30 wt. % tin, 5-15 wt. % bismuth and less than 2 wt. % of metals other than copper, tin and bismuth;

(b) 50-60 wt. % copper, 16-26 wt. % tin, 19-29 wt. % zinc and less than 2 wt. % of metals other than copper, tin and zinc; or (c) 33-43 wt. % tin, 12-22 wt. % bismuth, 40-50 wt. % zinc and less than 2 wt. % of metals other than tin, bismuth and zinc.

In certain embodiments of the method, the ingot is a cast ingot comprising 33-43 wt. % tin, 12-22 wt. % bismuth, 40-50 wt. % zinc and less than 2 wt. % of metals other than tin, bismuth and zinc.

In certain embodiments, the method is continuously conducted in a furnace.

In a third aspect of the invention there is provided a system for casting a copper-bismuth alloy, said system comprising:

at least one ingot of the invention; and a computer readable storage medium encoded with instructions that, when executed by a processor, cause the processor to: (i) provide a recipe for combining the at least one ingot with at least one feedstock metal composition to yield a desired product; and/or (ii) actuate at least one dispenser holding the at least one ingot to dispense one or more of the at least one ingot.

In certain embodiments of the inventive system, the computer readable storage medium is hosted remotely from a user and accessed via a communications network.

In certain embodiments, the system comprises at least two different types of the at least one ingot, each of the types being adapted for casting with a corresponding one of a plurality of different feedstock metal compositions, and each of the types being held in a respective container of the at least one dispenser, or in a respective dispenser.

DETAILED DESCRIPTION OF PREFERRED EMBODIMENTS OF THE INVENTION

As used throughout, ranges are used as shorthand for describing each and every value that is within the range. Any value within the range can be selected as the terminus of the range.

In addition, all references cited herein are hereby incorporated by reference in their entireties. In the event of a conflict in a definition in the present disclosure and that of a cited reference, the present disclosure controls.

Furthermore, the compositions and the methods may comprise, consist essentially of, or consist of the elements described herein.

Unless otherwise specified, all percentages and amounts expressed herein and elsewhere in the specification should be understood to refer to percentages by weight. The amounts given are based on the active weight of the material. The recitation of a specific value herein is intended to denote that value, plus or minus a degree of variability to account for errors in measurements. For example, an amount of 10% may include 9.5% or 10.5%, given the degree of error in measurement that will be appreciated and understood by those having ordinary skill in the art.

The invention provides viable alternatives to the high cost of using cast ingots of C89833 and C89836 alloys. These alloys have the following chemical specifications.

| Element | C89833 | C89836 |
|---|---|---|
| Copper | 86.0-91.0 | 87.0-91.0 |
| Tin | 4.0-6.0 | 4.0-7.0 |
| Lead | ≤0.09 | ≤0.25 |
| Zinc | 2.0-6.0 | 2.0-4.0 |
| Iron | ≤0.30 | ≤0.35 |
| Nickel | ≤1.0 | ≤0.90 |
| Antimony | ≤0.25 | ≤0.25 |
| Aluminum | ≤0.005 | ≤0.005 |
| Silicon | ≤0.005 | ≤0.005 |
| Bismuth | 1.7-2.7 | 1.5-3.5 |

In its various aspects, the invention includes mechanical ingots, cast ingots, methods for making them, methods for using them and systems including them.

Mechanical Ingots

A mechanical ingot is a heterogeneous assembly comprising two or more different metals and/or metal alloys which when melted (optionally with a predetermined quantity of at least one additional metal(s)) provides a desired alloy, which conforms to published specifications. The mechanical ingot is heterogeneous in the sense that at least two of the metals and/or metal alloys therein are physically distinguishable upon visual inspection of the external and/or internal portions of the mechanical ingot. The ingots are mechanical in the sense that they are formed by mechanical combination rather than being cast, although elements of the mechanical ingot precursor can be cast, so long as at least two components of the mechanical ingot precursor are mechanically combined.

The mechanical ingot comprises at least two members selected from the group consisting of copper, tin, zinc and bismuth. When present in the mechanical ingot, copper preferably constitutes 40-95 wt. % or 45-90 wt. % or 51-86 wt. % of the ingot. When present in the mechanical ingot, tin preferably constitutes 3-80 wt. % or 5-75 wt. % or 19-70 wt. % of the ingot. When present in the mechanical ingot, zinc preferably constitutes 1-80 wt. % or 4-77 wt. % or 22-73 wt. % of the ingot. When present in the mechanical ingot, bismuth preferably constitutes 1-40 wt. % or 2-35 wt. % or 8-31 wt. % of the ingot.

Certain embodiments of the mechanical ingot are substantially copper-free (i.e., contain copper in only trace amounts of less than 1 wt. %) and are adapted to form a C89833 or C89836 alloy on melting with a predetermined amount of copper separate from the mechanical ingot.

The mechanical ingot can further comprise metals other than tin, zinc, bismuth and copper in a collective amount of 0-5 wt. %, preferably 0-2 wt. % and more preferably 0-1 wt. %. The mechanical ingot is preferably substantially lead free, which as defined herein means that the mechanical ingot contains no more than 0.5 wt. % lead.

It is preferred to highly compact the mechanical ingot so as to reduce the surface area of the master alloy and reduce oxidation of the metals therein, particularly zinc. Densely compacted mechanical ingots will improve product yields versus randomly throwing various feedstock elements into a bath.

Cast Ingot

A cast ingot is an ingot formed from a molten mixture of metals.

The cast ingot comprises at least two members selected from the group consisting of copper, tin, zinc and bismuth, provided that when copper is present in the cast ingot in an amount greater than 69 wt. %, zinc is present in an amount less than 30 wt. %.

When present in the cast ingot, copper preferably constitutes 40-80 wt. % or 45-75 wt. % or 50-69 wt. % of the ingot. When present in the cast ingot, tin preferably constitutes 3-80 wt. % or 5-75 wt. % or 19-70 wt. % of the ingot. When present in the cast ingot, zinc preferably constitutes 1-80 wt. % or 4-77 wt. % or 22-73 wt. % of the ingot. When present in the cast ingot, bismuth preferably constitutes 1-40 wt. % or 2-35 wt. % or 8-31 wt. % of the ingot.

The cast ingot can further comprise metals other than tin, zinc and bismuth in a collective amount of 0-5 wt. %, preferably 0-2 wt. % and more preferably 0-1 wt. %. The cast ingot is preferably substantially lead free in that it contains no more than 0.5 wt. % lead.

Certain embodiments of the cast ingot are substantially copper-free (i.e., contain copper in only trace amounts of less than 1 wt. %) and are adapted to form a C89833 or C89836 alloy on melting with a predetermined amount of copper separate from the cast ingot.

Method of Making Ingots

Mechanical ingots for certain alloys have been available in the marketplace before. California Metal-X claims to have been selling mechanical ingots for over twenty-five years. See http://www.cmxmetals.com/mechanical-ingot/. However, the inventor is not aware of the prior existence of mechanical ingots containing all the ingredients (or all of the ingredients other than copper) necessary to produce a copper-bismuth alloy, such as C89833 alloy or C89836 alloy.

Thus, an aspect of the invention comprises the production of mechanical ingots adapted to produce copper-bismuth alloys, such as C89833 alloy or C89836 alloy. As used herein, the expression "copper-bismuth alloys" refers to mixtures comprising at least 50 wt. % copper, plus some amount of bismuth, and optionally other metals, such as tin and zinc. The mechanical ingots are preferably produced by casting a master alloy (which is a species of the cast ingot of the invention) of bismuth, tin and zinc, and then encasing (or otherwise mechanically combining) a specific quantity of this master alloy with a specific amount of copper. This mixture is compressed (preferably with a hydraulic press) to create a dense briquette, which is sized to be easily added to a melting furnace to yield a predictable chemical result.

The types and amounts of ingredients in the master alloy can be adjusted in view of the feedstock metal to be combined with the master alloy to form the mechanical ingot. Likewise, the types and amounts of feedstock metals (e.g., scrap metals) can be adjusted in view of the types and amounts of ingredients in the master alloy. Thus, the invention enables a variety of different scrap metals to be recycled into high value products, such as C89833 and C89836 alloys.

The order of addition of bismuth, tin and zinc to the furnace affects the quality of the master alloy. The three elements must be added in proper order at proper temperatures to obtain the desired results. Zinc should be added last because it oxidizes relatively easily, and melting other components last will reduce the quantity of zinc in the master alloy. The melting temperatures of bismuth (mp of 271.3° C.) and tin (mp of 231.9° C.) are similar, and each may be added to the furnace in any order so long as they are melted prior to the addition of zinc (mp of 419.6° C.).

In view of the sensitivity of zinc to oxidation, it is also unexpected that a continuous process of casting is possible. Despite the fact that a series of master alloys is added to the furnace, zinc in the master alloy is not unduly oxidized despite being melted along with tin and bismuth in the master alloy.

The shapes of ingots produced by the inventive method are not particularly limited. Suitable shapes include but are not limited to cuboids, spheres, cylinders (e.g., pucks) and irregularly shaped masses.

The dimensions of ingots of the invention are not particularly limited other than by the size limitations imposed by foundry vessels and means for charging them. The ingots are preferably small enough to fit in furnaces employed in foundries. In certain embodiments of the invention, the cast ingots are hexagonal in cross-section, wherein the length is 1 to 20 cm, the width is 1 to 5 cm, and the height is 1 to 5 cm. In certain embodiments of the invention, the mechanical ingots are cuboids, wherein the length is 10 to 50 cm, the width is 10 to 20 cm, and the height is 10 to 20 cm.

As used herein, the term "ingot" refers to a mass of at least one metal. Ingots of the invention have no particular function other than as feedstock for further processing. Thus, for example, ingots of the invention do not encompass solder.

Casting Method

In yet another aspect of the invention, a method of casting is provided. Ingots of the invention are melted to provide a molten metal mixture. A mold is filled with the molten metal mixture. The molten metal mixture in the mold is cooled such that a casting is formed.

In certain embodiments, the ingots of the invention are not adequate in and of themselves to produce the desired product upon casting. In these embodiments, the ingots are combined with metals to achieve the desired result.

System

Still another aspect of the invention is a system for casting a copper-bismuth alloy. The system includes at least one ingot of the invention. In preferred embodiments, the system further includes a computer readable storage medium encoded with instructions that, when executed by a processor, cause the processor to: (i) provide a recipe for combining the at least one ingot with at least one feedstock metal composition to yield a desired product; and/or (ii) actuate at least one dispenser holding the at least one ingot to dispense one or more of the at least one ingot.

The computer readable storage medium can be physically included in the system in the form of, e.g., software on a CD, DVD, or flashdrive, programmed hardware, or can be accessed on a remote server via a communications network, such as the Internet or a telecommunications network. Remote access can be afforded via means included in the system, such as a login instructions on printed material and/or a computer readable storage medium adapted to interface with a remote host of the executable instructions that predict a chemical analysis.

Suitable processors are not particularly limited. For example, the processor may be embodied as one or more of various processing means or devices such as a coprocessor, a microprocessor, a controller, a digital signal processor (DSP), a processing element with or without an accompanying DSP, or various other processing devices including integrated circuits such as, for example, an ASIC (application specific integrated circuit), an FPGA (field programmable gate array), a microcontroller unit (MCU), a hardware accelerator, a special-purpose computer chip, or the like.

A non-limiting example of the instructions that can be executed by the processor is provided in the following table, which represents an EXCEL spreadsheet that can be used to calculate the proper combination of feedstock metals to produce an alloy of a desired composition.

| | A | B | C | D | E | F |
|---|---|---|---|---|---|---|
| 1 | Scrap Grade | Weight | Copper | Tin | Zinc | Bismuth |
| 2 | | | | | | |
| 3 | Copper Pipe | 8850 | 100 | 0 | 0 | 0 |
| 4 | Tin Copper | 0 | 99 | 1 | 0 | 0 |
| 5 | 260 scrap | 0 | 70 | 0 | 30 | 0 |
| 6 | 425 scrap | 0 | 88 | 2 | 10 | 0 |
| 7 | 510 scrap | 0 | 95.5 | 4.5 | 0 | 0 |
| 8 | 521 scrap | 0 | 92.5 | 7.5 | 0 | 0 |
| 9 | 524 scrap | 0 | 90.5 | 9.5 | 0 | 0 |
| 10 | Master Alloy | 1150 | 0 | 38 | 45 | 17 |
| 11 | Totals | 10000 | 8850 | 437 | 517.5 | 195.5 |
| 12 | | | | | | |
| 13 | Projected Analysis | | 88.50% | 4.37% | 5.18% | 1.96% |

The numerical values in columns C-F are fixed based on the chemical analysis of a particular grade of scrap, the weights in column B are variables input by the user and the formulas for rows 11 and 13 are as follows:

$$B11=\mathrm{SUM}(B3{:}B10)$$

$$C11=+((C3*B3)+(C4*B4)+(C5*B5)+(C6*B6)+(C7*B7)+(C8*B8)+(C9*B9)+(C10*B10))/100$$

$$D11=+((D3*B3)+(D4*B4)+(D5*B5)+(D6*B6)+(D7*B7)+(D8*B8)+(D9*B9)+(D10*B10))/100$$

$$E11=+((E3*B3)+(E4*B4)+(E5*B5)+(E6*B6)+(E7*B7)+(E8*B8)+(E9*B9)+(E10*B10))/100$$

$$F11=+((F3*B3)+(F4*B4)+(F5*B5)+(F6*B6)+(F7*B7)+(F8*B8)+(F9*B9)+(F10*B10))/100$$

$$C13=+C11/B11$$

$$D13=+D11/B11$$

$$E13=+E11/B11$$

$$F14=+F11/B11$$

The user can adjust the variable in column B of the spreadsheet so as to determine a blend of ingredients suitable to prepare an alloy having the projected analysis in row 13. The spreadsheet can also be used to design master alloys tailored for use with particular scrap metals.

Of course, the spreadsheet can be modified to add or subtract different scrap metal grades (or more generally, different grades of feedstock that may or may not be scrap metal) as they become available or unavailable in the marketplace.

In embodiments of the system including at least one dispenser, the dispenser is adapted to store and dispense at least one ingot under automated control. Typically, but not exclusively, the dispenser is arranged so as to dispense at least one ingot into a furnace for melting and subsequent casting.

Dispensers suitable for use in the invention should be compatible with the metals being handled and the environment adjacent to a foundry furnace. For example, the dispenser can be a gravity-fed columnar container having an electronically controlled gate adapted to regulate the passage of a stack of ingots therethrough. In another exemplary embodiment, the dispenser can comprise a robotic arm adapted to remove ingots from a storage container and deposit the ingots in a furnace.

Certain embodiments of the system include at least two different types of ingot, wherein each of the ingot types is adapted for casting with a corresponding one of a plurality of different feedstock metal compositions. Thus, for example, a system might include a first class of ingots adapted to produce C89833 alloy and/or C89836 alloy when combined with only copper pipe, a second class of ingots adapted to produce C89833 alloy and/or C89836 alloy when combined with only 260 scrap (70 wt. % copper and 30 wt. % zinc), and printed materials, such as labels, instruction manuals, worksheets, etc. The printed materials identify the different classes of ingots and/or how to use them.

In preferred embodiments, the selecting and dispensing of the at least two different types of ingot is automated The invention will be illustrated in more detail with reference to the following Examples, but it should be understood that the present invention is not deemed to be limited thereto.

EXAMPLES

Example 1

Master Alloy Preparation 380 kg of pure tin and 170 kg of pure bismuth were added to a furnace, and the temperature was increased to 270° C. After melting the tin and bismuth, the temperature was further increased to 420° C., and 450 kg of pure zinc were added to form a molten mixture of tin, bismuth and zinc. The molten mixture was cast and cooled to form master alloy ingots comprising 38.00 wt. % tin, 17.35 wt. % bismuth and 44.60 wt. % zinc. Master alloy ingots were hexagonal in cross-section with a length of 1 to 20 cm, a width of 1 to 5 cm, and a height of 1 to 5 cm.

Example 2

Preparation of Cast Ingot of C89833 Alloy 16.01 kg of copper pieces (each being approximately 0.20 cm×0.20 cm×0.40 cm) were melted. 2.041 kg of master alloy was cut up into pieces (each being approximately 2 cm×2 cm×2 cm) and added to the molten copper along with 0.05 kg of phos-copper shot (85 wt. % copper and 15 wt. % phosphorous). Once mixed together, the molten metal mixture was poured onto an ingot mold. Chemical analysis of a sample taken from the resulting cast ingot in shown in Table 1 below.

TABLE 1

Chemical analysis of cast ingot of Example 2

| Element | Run 1 (wt. %) | Run 2 (wt. %) | Average (wt. %) |
|---|---|---|---|
| Copper | 89.195 | 88.869 | 89.014 |
| Tin | 4.2511 | 4.2981 | 4.2746 |
| Lead | 0.015 | 0.016 | 0.015 |
| Zinc | 4.509 | 4.531 | 4.520 |
| Iron | 0.012 | 0.012 | 0.012 |
| Nickel | 0.000 | 0.000 | 0.000 |
| Antimony | 0.010 | 0.009 | 0.010 |
| Phosphorous | 0.010 | 0.009 | 0.009 |
| Sulfur | 0.000 | 0.000 | 0.000 |
| Aluminum | 0.003 | 0.003 | 0.003 |
| Silicon | 0.003 | 0.003 | 0.003 |
| Bismuth | 2.0246 | 2.2455 | 2.1351 |
| Manganese | 0.001 | 0.001 | 0.001 |
| Carbon | 0.002 | 0.003 | 0.002 |
| Magnesium | 0.001 | 0.001 | 0.001 |
| Beryllium | 0.000 | 0.000 | 0.000 |
| TOTALS | 100 | 100 | 100 |

Example 3

Preparation of Mechanical Ingot and Casting of C89833 Alloy 88.75 wt. % copper and 11.25 wt. % of the master alloy of Example 1 were combined and compressed to form mechanical ingots (each being a cuboid with a length of 10 to 50 cm, a width of 10 to 20 cm, and a height of 10 to 20 cm).

The mechanical ingots were then melted and poured onto an ingot mold. Chemical analysis of a sample taken from the resulting cast ingot in shown in Table 2 below.

TABLE 2

Chemical analysis of ingot of Example 3

| Element | Content (wt. %) |
|---|---|
| Copper | 90.02 |
| Tin | 4.34 |
| Lead | 0.037 |
| Zinc | 3.60 |
| Iron | 0.00 |
| Nickel | 0.03 |
| Antimony | 0.01 |
| Phosphorous | 0.00 |
| Sulfur | 0.00 |
| Aluminum | 0.002 |
| Silicon | 0.002 |
| Bismuth | 1.85 |
| Arsenic | 0.006 |
| Manganese | 0.009 |
| Selenium | 0.10 |
| TOTAL | 100 |

The foregoing examples demonstrate how the invention provides effective and efficient means for producing C89833 alloys. The compositions of the master alloy, the mechanical ingot and/or any feedstock being combined with the foregoing can be varied as desired to produce a virtually unlimited variety of alloys. The precise composition of the master alloy can be varied to account for the presence or absence from the feedstock copper of tin, bismuth and/or zinc. Uniform feedstock (e.g., phos-bronze scrap, which is 96 wt. % copper and 4 wt. % tin; commercial bronze scrap, which is 90 wt. % copper and 10 wt. % zinc) can be substituted to some extent for the feedstock copper to reduce overall costs, as such mixed feedstock products can typically be bought at a discount relative to the intrinsic values of the metals therein.

While the invention has been described in detail and with reference to specific examples thereof, it will be apparent to one skilled in the art that various changes and modifications can be made therein without departing from the spirit and scope thereof.

What is claimed is:

1. An ingot wherein the ingot is a cast ingot comprising 33-43 wt. % tin, 12-22 wt. % bismuth, 40-50 wt. % zinc and less than 2 wt. % of metals other than tin, bismuth and zinc.

* * * * *